US008443603B2

(12) United States Patent
Hayman et al.

(10) Patent No.: US 8,443,603 B2
(45) Date of Patent: May 21, 2013

(54) INTAKE MANIFOLD ASSEMBLY FOR DEDICATED EXHAUST GAS RECIRCULATION

(75) Inventors: Alan W. Hayman, Romeo, MI (US); Rodney E. Baker, Fenton, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 212 days.

(21) Appl. No.: 13/104,532

(22) Filed: May 10, 2011

(65) Prior Publication Data

US 2012/0285426 A1 Nov. 15, 2012

(51) Int. Cl.
*F02B 33/44* (2006.01)
*F02B 47/08* (2006.01)

(52) U.S. Cl.
USPC ..... 60/605.2; 123/568.11

(58) Field of Classification Search
USPC ..... 60/605.2; 123/568.11, 568.17, 568.18
See application file for complete search history.

(56) References Cited

U.S. PATENT DOCUMENTS

| | | | | |
|---|---|---|---|---|
| 5,168,838 | A * | 12/1992 | Seike et al. | 123/184.31 |
| 6,216,461 | B1 | 4/2001 | Shao et al. | |
| 6,675,579 | B1 * | 1/2004 | Yang | 60/599 |
| 7,043,914 | B2 | 5/2006 | Ishikawa | |
| 8,020,539 | B2 * | 9/2011 | Maunoury | 123/568.18 |
| 2009/0308070 | A1 | 12/2009 | Alger, II et al. | |
| 2011/0041495 | A1 | 2/2011 | Yager | |
| 2012/0204845 | A1 * | 8/2012 | Gingrich et al. | 123/568.17 |

* cited by examiner

*Primary Examiner* — Thomas Denion
*Assistant Examiner* — Ngoc T Nguyen
(74) *Attorney, Agent, or Firm* — Quinn Law Group, PLLC

(57) ABSTRACT

An intake manifold assembly for an internal combustion engine of a vehicle includes a plenum, a plurality of lower runners coupled to and in fluid communication with the plenum, and a plurality of upper runners. Each of the upper runners is coupled to and in fluid communication with one of the lower runners. The plurality of upper runners includes a single dedicated upper EGR runner configured for supplying combustion air to at least two dedicated EGR cylinders. A primary throttle body is coupled to the plenum and configured for regulating a flow rate of compressed combustion air through the plenum. An EGR throttle body is coupled to the dedicated upper EGR runner and configured for regulating a flow rate of the compressed combustion air through the dedicated upper EGR runner to control the flow rate of the compressed combustion air to the dedicated EGR cylinders.

20 Claims, 4 Drawing Sheets

INTAKE MANIFOLD ASSEMBLY FOR DEDICATED EXHAUST GAS RECIRCULATION

TECHNICAL FIELD

The invention generally relates to an intake manifold assembly for an internal combustion engine of a vehicle having at least two cylinders operable in a dedicated Exhaust Gas Recirculation (EGR) mode.

BACKGROUND

Internal combustion engines may re-circulate exhaust gas from one or more dedicated cylinders to an intake manifold, typically referred to as Exhaust Gas Recirculation (EGR), to improve fuel efficiency of the vehicle and/or reduce engine emissions. Because the exhaust gas from the dedicated EGR cylinders is directed to the intake manifold, the necessary operation of the dedicated EGR cylinders, e.g., the fuel/air mixture ratio, may need to vary from the non-dedicated EGR cylinders, and the amount to exhaust gas delivered by the dedicated EGR cylinders may need to be regulated.

SUMMARY

An internal combustion engine is provided. The internal combustion engine includes an engine block defining a plurality of cylinders. At least two of the plurality of cylinders are configured for operating as dedicated EGR cylinders. A cylinder head assembly is attached to the engine block. The cylinder head assembly defines a plurality of intake ports. Each intake port is configured for supplying combustion air to a respective one of the plurality of cylinders. A compressor is coupled to the engine block, and is configured for compressing the combustion air. An intake manifold assembly is configured for directing the compressed combustion air from the compressor to each of the plurality of intake ports. The intake manifold assembly includes a plenum coupled to and in fluid communication with the compressor, a plurality of lower runners coupled to and in fluid communication with the plenum, and a plurality of upper runners. Each of the upper runners is coupled to and in fluid communication with a respective one of the lower runners and at least one of the intake ports of the cylinder head assembly. The plurality of lower runners includes a single dedicated lower EGR runner. The dedicated lower EGR runner is configured to supply the combustion air to both of the dedicated EGR cylinders.

An intake manifold assembly for an internal combustion engine including at least two dedicated EGR cylinders is also provided. The intake manifold assembly includes a plenum, a plurality of lower runners and a plurality of upper runners. The plurality of lower runners is coupled to and in fluid communication with the plenum. Each of the plurality of upper runners is coupled to and in fluid communication with a respective one of the lower runners. The plurality of lower runners includes a single dedicated lower EGR runner configured for supplying combustion air to the at least two dedicated EGR cylinders.

A vehicle is also provided. The vehicle includes an engine block that defines a plurality of cylinders. At least two of the plurality of cylinders is configured for operating as dedicated EGR cylinders. A cylinder head assembly is attached to the engine block, and defines a plurality of intake ports. Each intake port is configured for supplying combustion air to a respective one of the plurality of cylinders. A compressor is coupled to the engine block. The compressor is configured for compressing the combustion air. An intake manifold assembly is configured for directing the compressed combustion air from the compressor to each of the plurality of intake ports. The intake manifold assembly includes a plenum coupled to and in fluid communication with the compressor, a plurality of lower runners coupled to and in fluid communication with the plenum, and a plurality of upper runners. Each of the upper runners is coupled to and in fluid communication with a respective one of the lower runners and at least one of the intake ports of the cylinder head assembly. A primary throttle body is coupled to the plenum. The primary throttle body is configured for regulating a flow rate of the compressed combustion air through the plenum. The plurality of lower runners includes a single dedicated lower EGR runner configured to supply the combustion air to both of the dedicated EGR cylinders. The plurality of upper runners includes a single dedicated upper EGR runner in fluid communication with the dedicated lower EGR runner and the intake ports in fluid communication with the at least two dedicated EGR cylinders. An EGR throttle body is disposed between the dedicated lower EGR runner and the dedicated upper EGR runner. The EGR throttle body is configured for regulating a flow rate of the compressed combustion air through the dedicated upper EGR runner.

Accordingly, the EGR throttle body may be used to control the flow rate of combustion air to the dedicated EGR cylinders to vary the flow rate of combustion air from the flow rate of combustion air provided to the non-dedicated EGR cylinders, i.e., working cylinders, and thereby vary the flow of re-circulated exhaust gas provided to all of the cylinders through the dedicated EGR cylinders. The additional control of the dedicated EGR cylinders provided by the EGR throttle body allows for improved operation and performance of the internal combustion engine. The single dedicated lower runner and the single dedicated upper runner that supply the at least two dedicated EGR cylinders allow for a single EGR throttle body to be used to control the flow rate of combustion air to the dedicated EGR cylinders.

The above features and advantages and other features and advantages of the present invention are readily apparent from the following detailed description of the best modes for carrying out the invention when taken in connection with the accompanying drawings.

DETAILED DESCRIPTION

Those having ordinary skill in the art will recognize that terms such as "above," "below," "upward," "downward," "top," "bottom," etc., are used descriptively for the figures, and do not represent limitations on the scope of the invention, as defined by the appended claims.

Figure 1:
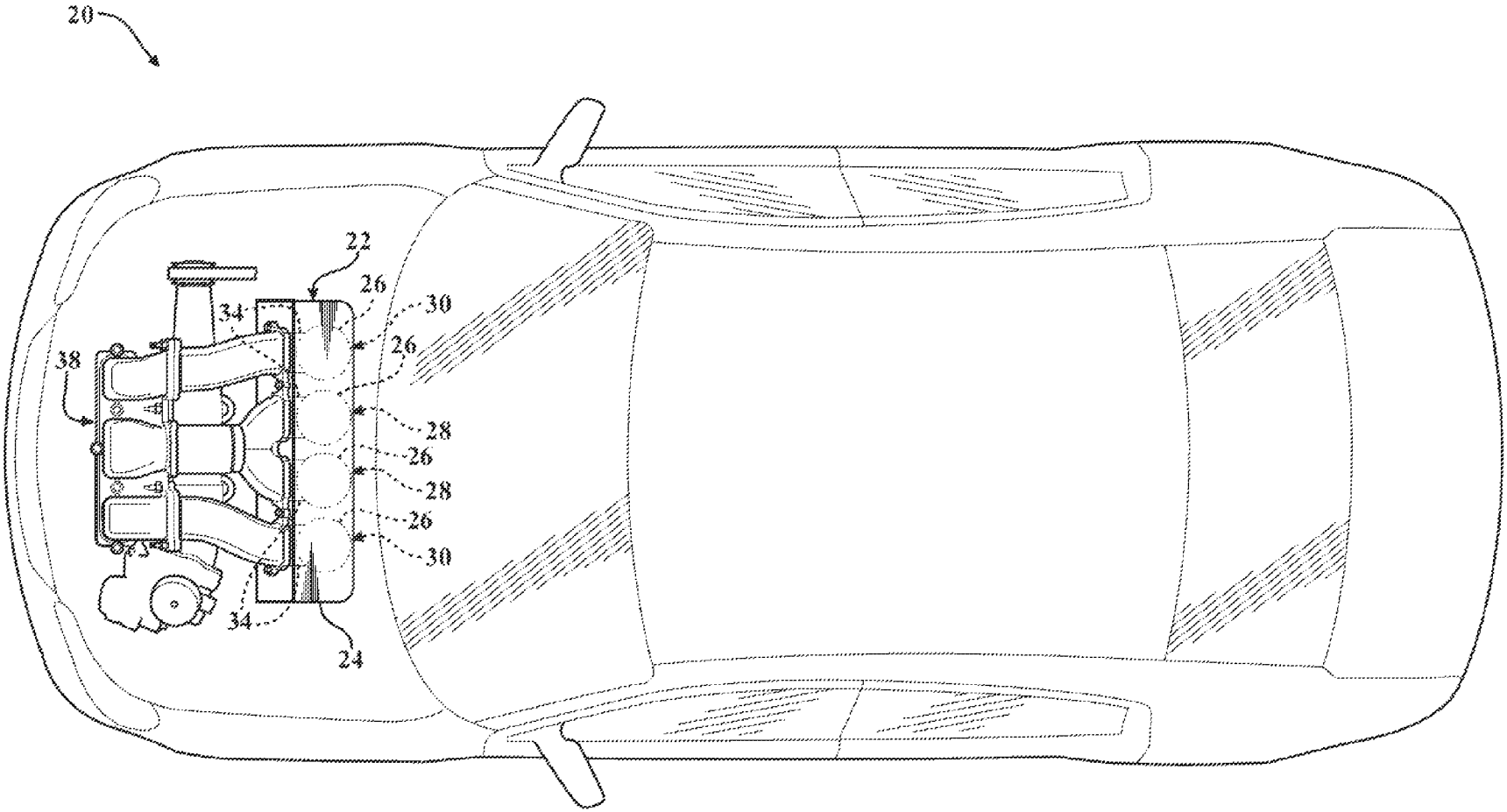
FIG. 1 is a schematic plan view of a vehicle.

Referring to the Figures, wherein like numerals indicate like parts throughout the several views, a vehicle is generally shown at 20 in FIG. 1. The vehicle 20 includes an internal combustion engine 22 for powering the vehicle 20. The internal combustion engine 22 may include but is not limited to a diesel engine or a gasoline engine. As shown in the Figures, the internal combustion engine 22 includes an in-line four cylinder engine. However, it should be appreciated that the internal combustion engine 22 may include any suitable size and/or configuration of engine, including but not limited to an in-line six cylinder engine, a v-style six cylinder engine, or a v-style eight cylinder engine.

Figure 4:
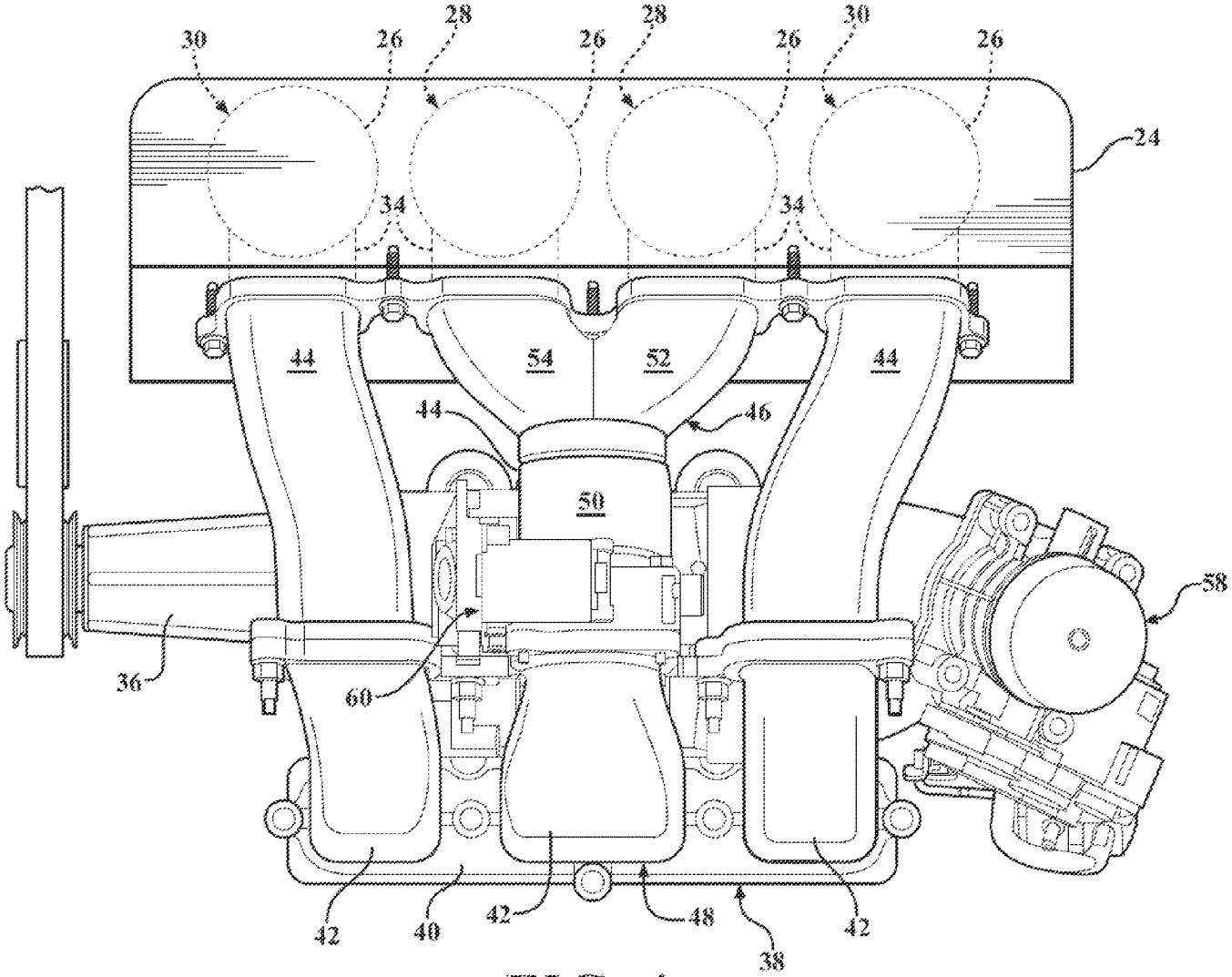
FIG. 4 is a schematic plan view of an intake manifold assembly of the internal combustion engine.

The internal combustion engine 22 includes an engine block 24. As best shown in FIG. 4, the engine block 24 defines a plurality of cylinders 26, with at least two of the plurality of cylinders 26 configured for operating as dedicated Exhaust Gas Recirculation (EGR) cylinders 28. As used herein, the term dedicated EGR cylinders 28 refers to cylinders 26 that may direct up to one hundred percent of their exhaust gas back to an intake manifold to establish an EGR operating mode. In contrast, the cylinders 26 of the internal combustion engine 22 that are not used as dedicated EGR cylinders 28 may be referred to as working cylinders 30. Preferably, the cylinders 26 configured for operating as the dedicated EGR cylinders 28 include one half of a total number of the plurality of cylinders 26 defined by the engine block 24. As shown, the engine block 24 defines a total of four cylinders 26, with two of the four cylinders 26 configured for operating as the dedicated EGR cylinders 28, and the other two cylinders 26 configured as working cylinders 30. However, it should be appreciated that the number of dedicated EGR cylinders 28 and the number of working cylinders 30 may vary with different configurations and/or styles of engines from the two dedicated EGR cylinders 28 and the two working cylinders 30 shown and described herein. For example, an in-line six cylinder engine may include three dedicated EGR cylinders 28, and three working cylinders 30, or may alternatively include two dedicated EGR cylinders 28 and four working cylinders 30.

Figure 2:
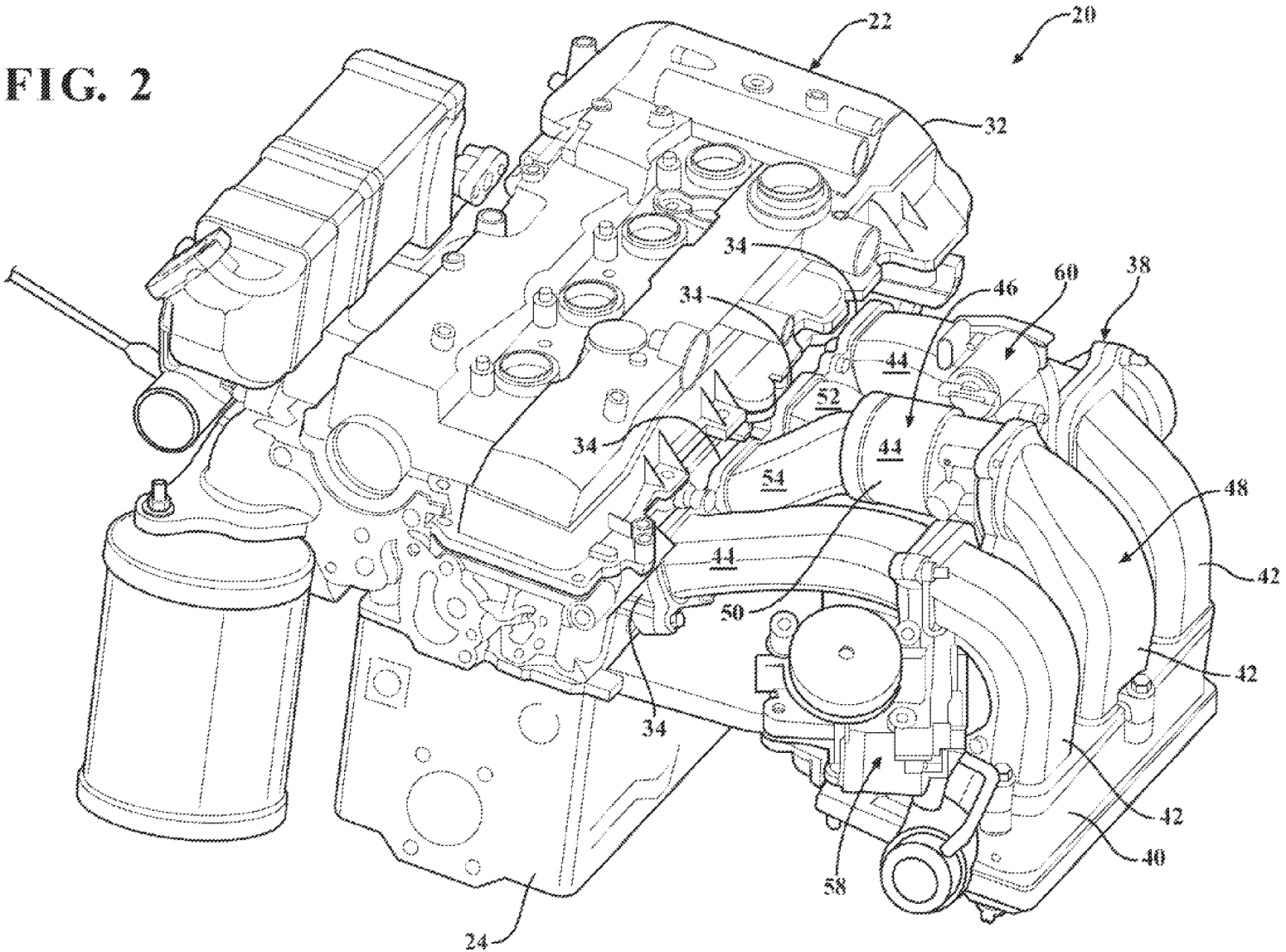
FIG. 2 is a schematic perspective view of an internal combustion engine of the vehicle.
Figure 3:
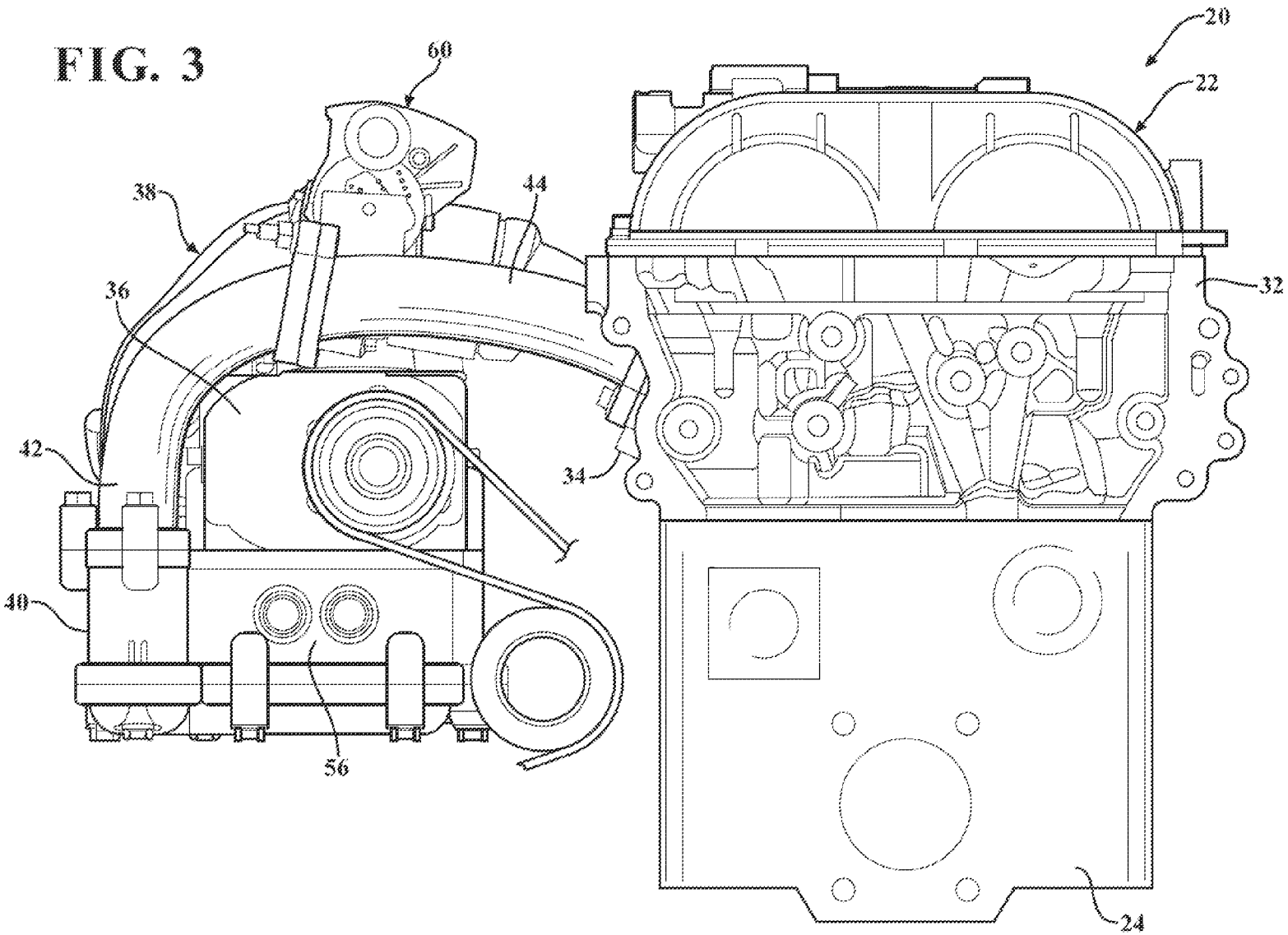
FIG. 3 is a schematic plan view of the internal combustion engine.

As best shown in FIGS. 2 and 3, a cylinder head assembly 32 is attached to the engine block 24. The cylinder head assembly 32 defines a plurality of intake ports 34. Each intake port 34 is in fluid communication with one of the cylinders 26 of the engine block 24, and is configured for supplying combustion air to one of the plurality of cylinders 26.

Referring to FIGS. 3 and 4, a compressor 36 is coupled to the engine block 24. The compressor 36 is configured for compressing the combustion air. Preferably, the compressor 36 includes a belt driven compressor 36, i.e., a supercharger. However, it should be appreciated that the compressor 36 may alternatively include a turbine driven compressor 36, i.e., a turbocharger, or some other similar device.

The internal combustion engine 22 includes an intake manifold assembly 38 that is configured for directing the compressed combustion air from the compressor 36 to each of the plurality of intake ports 34. Referring to FIGS. 2 through 4, the intake manifold assembly 38 includes a plenum 40, a plurality of lower runners 42, and a plurality of upper runners 44. The plenum 40 is coupled to and in fluid communication with the compressor 36 and the plurality of lower runners 42. The plenum 40 supplies the plurality of lower runners 42 with the flow of compressed combustion air.

The plurality of lower runners 42 is coupled to and in fluid communication with the plenum 40. The plurality of lower runners 42 includes a total number of lower runners 42 that is less than the total number of cylinders 26 defined by the engine block 24. As shown, the plurality of lower runners 42 includes a total of three lower runners 42. However, it should be appreciated that the total number of lower runners 42 may differ from that shown. For example, for the in-line four cylinder engine shown and described herein, the total number of lower runners 42 may include only two runners. It should further be appreciated that the total number of lower runners 42 may differ with differently sized and/or configured engines.

Each of the plurality of upper runners 44 is coupled to and in fluid communication with one of the lower runners 42 and at least one of the intake ports 34 of the cylinder head assembly 32. The plurality of upper runners 44 includes a total number of upper runners 44 that is equal to the total number of lower runners 42, and that is less than the total number of cylinders 26 defined by the engine block 24. As shown, the plurality of upper runners 44 includes a total of three upper runners 44. However, it should be appreciated that the total number of upper runners 44 may differ from that shown, and may differ with differently sized and/or configured engines.

Referring to FIGS. 2 and 4, the plurality of upper runners 44 includes a single dedicated upper EGR runner 46, and the plurality of lower runners 42 includes a single dedicated lower EGR runner 48. The dedicated upper EGR runner 46 is in fluid communication with the dedicated lower EGR runner 48 and the intake ports 34 of the cylinder head assembly 32 that are in fluid communication with the two dedicated EGR cylinders 28. The dedicated lower EGR runner 48 is coupled to and in fluid communication with the dedicated upper EGR runner 46, and is configured to supply the combustion air to the dedicated upper EGR runner 46 from the plenum 40, and thereby to both of the dedicated EGR cylinders 28.

The dedicated upper EGR runner 46 includes a primary passage 50 that is disposed adjacent the dedicated lower EGR runner 48. The primary passage 50 bifurcates to define at least a first intake runner 52 and a second intake runner 54. The first intake runner 52 and the second intake runner 54 are each in fluid communication with one intake port 34 of the cylinder head assembly 32. Accordingly, the first intake runner 52 is in fluid communication with one intake port 34, and the second intake runner 54 is in fluid communication with another, different, intake port 34. The first intake runner 52 and the second intake runner 54 direct the flow of the compressed combustion air from the primary passage 50 to each of the two dedicated EGR cylinders 28.

Referring to FIG. 3, an intercooler 56 may be disposed between and interconnects the compressor 36 and the plenum 40. The intercooler 56 connects the compressor 36 and the plenum 40 in fluid communication, and is configured for cooling the compressed combustion air. The intercooler 56 operates as is known in the art, and may include any suitable intercooler 56 commonly used with superchargers or turbochargers.

Referring to FIGS. 2 and 4, the internal combustion engine 22 further includes a primary throttle body 58. The primary throttle body 58 is coupled to the plenum 40, and is configured for regulating a flow rate of the compressed combustion air through the plenum 40. The primary throttle body 58 is a valve that opens and closes fluid communication to the plenum 40 to regulate how much of the compressed combustion air flows into the plenum 40 and thereby into the cylinders 26 for combustion. The primary throttle body 58 operates as is known in the art, and may include any suitable throttle body commonly used with internal combustion engines.

Referring to FIGS. 2 and 4, the intake manifold includes an EGR throttle body 60, which is separate and distinct from the primary throttle body 58. The EGR throttle body 60 is disposed between the dedicated lower EGR runner 48 and the dedicated upper EGR runner 46. The EGR throttle body 60 is a valve that opens and closes fluid communication to the dedicated upper EGR runner 46, and is configured for regulating a flow rate of the compressed combustion air through the dedicated upper EGR runner 46. Accordingly, the primary throttle body 58 regulates the flow of combustion air to all of the lower runners 42, whereas the EGR throttle body 60 may further regulate the flow of the compressed combustion air to the dedicated EGR cylinders 28, thereby providing an added level of adjustment and/or control to the operation of the internal combustion engine 22.

While the best modes for carrying out the invention have been described in detail, those familiar with the art to which this invention relates will recognize various alternative designs and embodiments for practicing the invention within the scope of the appended claims.

The invention claimed is:

1. An internal combustion engine comprising:

an engine block defining a plurality of cylinders, with at least two of the plurality of cylinders configured for operating as dedicated EGR cylinders;

a cylinder head assembly attached to the engine block and defining a plurality of intake ports, with each intake port configured for supplying combustion air to a respective one of the plurality of cylinders;

a compressor coupled to the engine block and configured for compressing the combustion air; and an intake manifold assembly including a plenum coupled to and in fluid communication with the compressor, a plurality of lower runners coupled to and in fluid communication with the plenum, and a plurality of upper runners, with each of the upper runners coupled to and in fluid communication with a respective one of the lower runners and at least one of the intake ports of the cylinder head assembly, wherein the intake manifold is configured for directing the compressed combustion air from the compressor to each of the plurality of intake ports;

wherein the plurality of lower runners includes a single dedicated lower EGR runner configured to supply the combustion air to both of the dedicated EGR cylinders.

2. An internal combustion engine as set forth in claim 1 further comprising a primary throttle body coupled to the plenum and configured for regulating a flow rate of the compressed combustion air through the plenum.

3. An internal combustion engine as set forth in claim 2 wherein the plurality of upper runners includes a single dedicated upper EGR runner in fluid communication with the dedicated lower EGR runner and the intake ports in fluid communication with the at least two dedicated EGR cylinders.

4. An internal combustion engine as set forth in claim 3 wherein the dedicated upper EGR runner includes a primary passage adjacent the dedicated lower EGR runner, and bifurcates to define a first intake runner and a second intake runner.

5. An internal combustion engine as set forth in claim 4 wherein the first intake runner and the second intake runner are each in fluid communication with one intake port of the cylinder head assembly.

6. An internal combustion engine as set forth in claim 4 further comprising an EGR throttle body disposed between the dedicated lower EGR runner and the dedicated upper EGR runner, and configured for regulating a flow rate of the compressed combustion air through the dedicated upper EGR runner.

7. An internal combustion engine as set forth in claim 1 further comprising an intercooler interconnecting the compressor and the plenum in fluid communication and configured for cooling the compressed combustion air.

8. An internal combustion engine as set forth in claim 1 wherein the at least two cylinders configured for operating as dedicated EGR cylinders includes one half a total number of the plurality of cylinders defined by the engine block.

9. An internal combustion engine as set forth in claim 1 wherein the engine block defines a total of four cylinders, with two cylinders configured for operating as the dedicated EGR cylinders.

10. An internal combustion engine as set forth in claim 9 wherein the plurality of lower runners includes a total of three lower runners.

11. An internal combustion engine as set forth in claim 10 wherein the plurality of upper runners includes a total of three upper runners.

12. An intake manifold assembly for an internal combustion engine including at least two dedicated EGR cylinders, the intake manifold assembly comprising:

a plenum;

a plurality of lower runners coupled to and in fluid communication with the plenum; and a plurality of upper runners, with each of the upper runners coupled to and in fluid communication with a respective one of the lower runners;

wherein the plurality of lower runners includes a single dedicated lower EGR runner configured for supplying combustion air to the at least two dedicated EGR cylinders.

13. An intake manifold assembly as set forth in claim 12 wherein the plurality of upper runners includes a single dedicated upper EGR runner in fluid communication with the dedicated lower EGR runner and configured for fluid communication with the at least two dedicated EGR cylinders.

14. An intake manifold assembly as set forth in claim 13 further comprising an EGR throttle body disposed between the dedicated lower EGR runner and the dedicated upper EGR runner.

15. An intake manifold assembly as set forth in claim 13 wherein the dedicated upper EGR runner includes a primary passage adjacent the dedicated lower EGR runner, and bifurcates to define a first intake runner and a second intake runner.

16. An intake manifold assembly as set forth in claim 14 further comprising a primary throttle body coupled to the plenum.

17. A vehicle comprising:

an engine block defining a plurality of cylinders, with at least two of the plurality of cylinders configured for operating as dedicated EGR cylinders;

a cylinder head assembly attached to the engine block and defining a plurality of intake ports, with each intake port configured for supplying combustion air to a respective one of the plurality of cylinders;

a compressor coupled to the engine block and configured for compressing the combustion air;

an intake manifold assembly including a plenum coupled to and in fluid communication with the compressor, a plurality of lower runners coupled to and in fluid communication with the plenum, and a plurality of upper runners, with each of the upper runners coupled to and in fluid communication with a respective one of the lower runners and at least one of the intake ports of the cylinder head assembly, wherein the intake manifold is configured for directing the compressed combustion air from the compressor to each of the plurality of intake ports;

a primary throttle body coupled to the plenum and configured for regulating a flow rate of the compressed combustion air through the plenum;

wherein the plurality of lower runners includes a single dedicated lower EGR runner configured to supply the combustion air to both of the dedicated EGR cylinders;

wherein the plurality of upper runners includes a single dedicated upper EGR runner in fluid communication with the dedicated lower EGR runner and the intake ports in fluid communication with the at least two dedicated EGR cylinders; and an EGR throttle body disposed between the dedicated lower EGR runner and the dedicated upper EGR runner, and configured for regulating a flow rate of the compressed combustion air through the dedicated upper EGR runner.

18. A vehicle as set forth in claim 17 wherein the dedicated upper EGR runner includes a primary passage adjacent the dedicated lower EGR runner, and bifurcates to define a first intake runner and a second intake runner.

19. A vehicle as set forth in claim 18 wherein the first intake runner and the second intake runner are each in fluid communication with one intake port of the cylinder head assembly.

20. A vehicle as set forth in claim 17 wherein:

the engine block defines a total of four cylinders, with two cylinders configured for operating as the dedicated EGR cylinders;

the plurality of lower runners includes a total of three lower runners; and wherein the plurality of upper runners includes a total of three upper runners.

* * * * *